US005562287A

United States Patent [19]

Endo et al.

[11] Patent Number: 5,562,287

[45] Date of Patent: Oct. 8, 1996

[54] TWO-PIECE GOLF BALL

[75] Inventors: Seiichiro Endo, Akashi; Kuniyasu Horiuchi, Kobe, both of Japan

[73] Assignee: Sumitomo Rubber Industries, Ltd., Hyogo-ken, Japan

[21] Appl. No.: 321,875

[22] Filed: Oct. 14, 1994

[30] Foreign Application Priority Data

Oct. 15, 1993 [JP] Japan ..... 5-258089

[51] Int. Cl.[6] ..... A63B 37/06; A63B 37/12

[52] U.S. Cl. ..... 273/377

[58] Field of Search ..... 273/220, 228; 473/377, 371, 372, 373, 374, 375, 376

[56] References Cited

U.S. PATENT DOCUMENTS

| | | | |
|---|---|---|---|
| 4,858,924 | 8/1989 | Saito et al. | 273/220 X |
| 5,033,748 | 7/1991 | Ebisuno | 273/218 |
| 5,403,010 | 4/1995 | Yabuki et al. | 273/220 |

FOREIGN PATENT DOCUMENTS

| | | |
|---|---|---|
| 2127303 | 4/1984 | United Kingdom . |
| 2232162 | 4/1989 | United Kingdom . |

OTHER PUBLICATIONS

DATABASE WPI, Week 8546, Derwent Publ. Ltd. An 85–287891 & JP–A–60 199 471.

*Primary Examiner*—George J. Marlo

*Attorney, Agent, or Firm*—Birch, Stewart, Kolasch & Birch, LLP

[57] ABSTRACT

Disclosed is a two-piece golf ball comprising a core made of a rubber composition containing a base rubber, a co-crosslinking agent and an organic peroxide, and a cover. The core of the golf ball contains 20 to 30 parts by weight of the co-crosslinking agent based on 100 parts by weight of the base rubber. A hardness of the core, measured by a JIS-C type hardness tester, is within a range from 70 to 80 at any part from the center to the surface and a difference in hardness at any part is not more than 5. An amount of compression deformation of the core formed between initial loading (10 kg) and final loading (130 kg) is 3.1 to 3.8 mm.

2 Claims, 1 Drawing Sheet

TWO-PIECE GOLF BALL

FIELD OF THE INVENTION

The present invention relates to a two-piece golf ball. More particularly, it relates to a two-piece golf ball having excellent hit feeling.

BACKGROUND OF THE INVENTION

A two-piece golf ball has widely been used because of its excellent flying performances. However, there is a problem that hit feeling of the two-piece golf ball is hard in comparison with a thread wound golf ball and it exhibits a harder feeling at the time of misshot. Therefore, two-piece golf balls having excellent feeling are requested.

Recently, various efforts have been made in order to obtain hit feeling which is similar to that of the thread wound golf ball. For example, the hit feeling may be improved by softening the core of the two-piece golf ball to decrease the total hardness of the golf ball. However, the golf ball obtained by this method lacks in concept of a hardness distribution of the core. Further, the golf ball feels soft but exhibits a heavy feeling and, therefore, it does not necessarily have a hit feeling which is similar to that of the thread wound golf ball.

SUMMARY OF THE INVENTION

Under these circumstances, the present inventors have paid attention to the hardness distribution of the core and compression strength and studied intensively about them. As a result, it has been found that, by making the hardness distribution of the core uniform within a range from the center to the surface, adjusting the compression strength of the core and optimizing the both, it becomes possible to feel softness of the core and a suitable hardness of the cover, thereby affording a two-piece golf ball which is soft and superior in hit feeling, and which has excellent flying distance in comparison with a conventional golf ball. As a matter of course, the resulting two-piece golf ball flies for a long distance at the time of iron shot and has excellent control properties.

That is, the main object of the present invention is to provide a two-piece golf ball having a hit feeling which is extremely similar to that of a thread wound golf ball by controlling characteristics of the core of the two-piece golf ball.

This objects as well as other objects and advantages of the present invention will become apparent to those skilled in the art from the following description.

The present invention provides a two-piece golf ball comprising a core made of a rubber composition containing a base rubber, a co-crosslinking agent and an organic peroxide, and a cover covering the core, said core containing 20 to 30 parts by weight of the co-crosslinking agent based on 100 parts by weight of the base rubber, a hardness of said core, measured by a JIS-C type hardness tester, being within a range from 70 to 80 at any part from the center to the surface, a difference in hardness at any part being not more than 5 and a compression deformation of said core formed between initial loading (10 kg) and final loading (130 kg) being 3.1 to 3.8 mm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
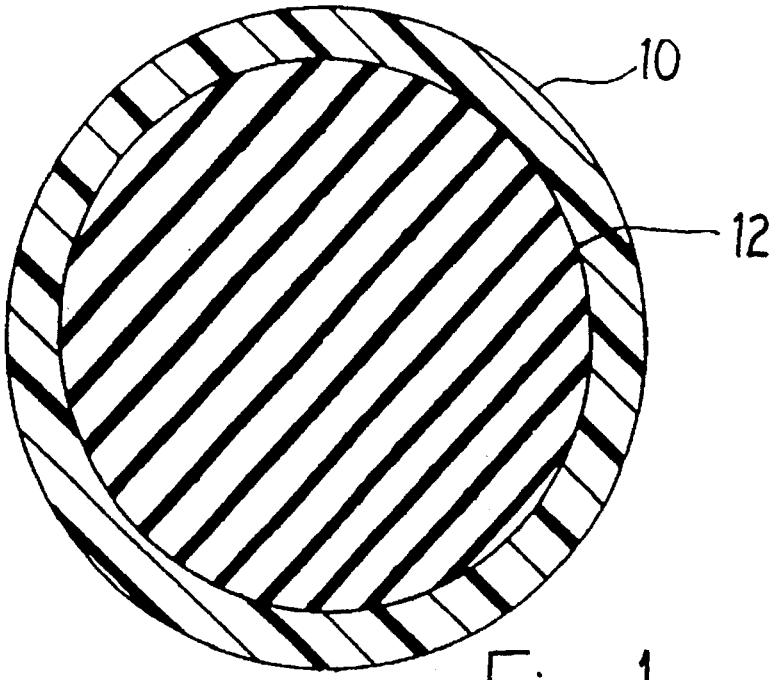
FIG. 1 is a cross-sectional view through the golf ball according to the present invention.
Figure 2:
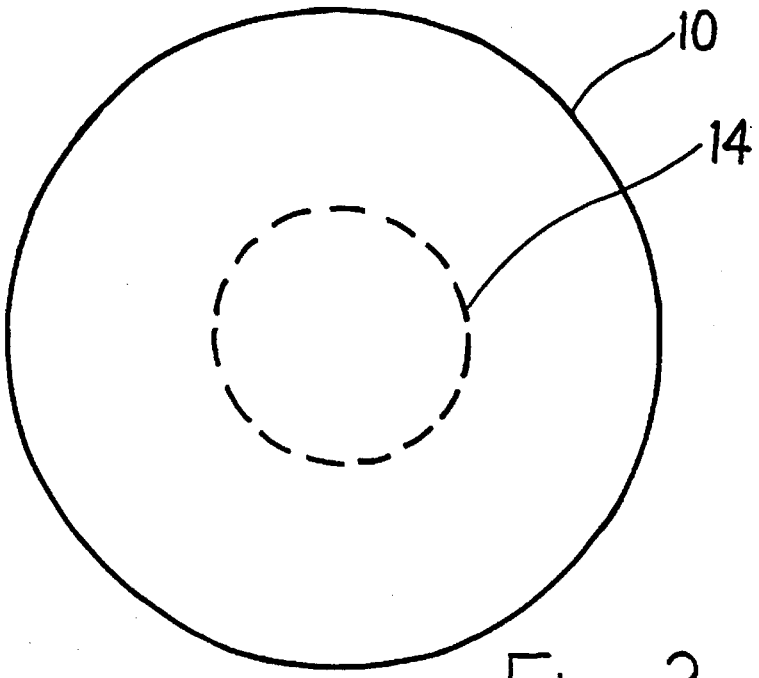
FIG. 2 is a schematic view of a golf ball according to the present invention showing a contact area.

In the present invention, as the base rubber, there can be used natural rubbers and/or synthetic rubbers which have hitherto been used for a two-piece core. Particularly, a cis-1, 4-polybutadiene rubber having at least 40% of a cis-structure is preferred. If necessary, natural rubber, polyisoprene rubber, styrene-butadiene rubber, EPDM, etc. may be suitably added to the above polybutadiene rubber.

The co-crosslinking agent is not specifically limited, and examples thereof include metal salts of unsaturated carboxylic acids, particularly monovalent or divalent metal salts of unsaturated carboxylic acids having 3 to 8 carbon atoms (e.g. acrylic acid, methacrylic acid, etc.). Among them, zinc acrylate is particularly preferred. An amount of the co-crosslinking agent is preferably 20 to 30 parts by weight based on 100 parts by weight of the base rubber. When the amount is smaller than 20 parts by weight, the hardness of the golf ball becomes low and an excessively heavy and inferior feeling is obtained. Further the durability also becomes inferior. On the other hand, when the amount exceeds 30 parts by weight, the golf ball becomes too hard and an inferior feeling is obtained.

Examples of the organic peroxide include dicumyl peroxide, di-t-butyl peroxide and the like. Among them, dicumyl peroxide is particularly preferred. An amount of the organic peroxide is 0.5 to 5.0 parts by weight, preferably 0.8 to 3.0 parts by weight, based on 100 parts by weight of the base rubber. When the amount is smaller than 0.5 parts by weight, the hardness of the golf ball becomes low and an excessively heavy and inferior feeling is obtained. On the other hand, when the amount exceeds 5.0 parts by weight, the golf ball becomes too hard and an inferior feeling is obtained.

If necessary, additives such as fillers, antioxidants, etc. may be added to the rubber composition used in the golf ball of the present invention. Examples of the filler include zinc oxide, barium sulfate and the like. An amount of the filler varies depends on a specific gravity, size, etc. of the cover and core and is not specifically limited, but is normally 10 to 40 parts by weight based on 100 parts by weight of the base rubber.

The core 12 of the two-piece golf ball of the present invention is produced by heating at a heating temperature, at which a peak of temperature rise of the center part due to internal heat generation appears after 20 minutes has passed since the beginning of heating, for 20 minutes or more to adjust the hardness (measured by a JIS-C hardness tester) at the center part to 70 or more and then heating continuously at the same or higher temperature to adjust the hardness (measured by a JIS-C hardness tester) at the surface part to 70 to 80. By using this method, the hardness of the resulting golf ball becomes within a range from 70 to 80 and a difference in hardness at any part becomes not more than 5. The terms difference in hardness at any part is not more than 5" means that a difference in hardness measured at any part of the core 12 between maximum value and minimum value is within 5. Because of indefinite factors such as error of measurement, etc., the limitation "within 5" is not severe and it is understood that some deviation may exist.

When the heating is conducted at a temperature, at which a peak of temperature rise of the center part due to internal heat generation appears before 20 minutes has passed since the beginning of heating, internal heat regeneration is liable to be arisen rapidly to cause heat deterioration. Further, when the heating time is smaller than 20 minutes, the internal vulcanization becomes insufficient. When the hardness is lower than the above range, the durability is deteriorated and too soft and heavy feeling is obtained. When the hardness is higher than the above range, an impact force at the time of hitting is large and an inferior feeling is obtained.

In the present invention, it is necessary that an amount of compression deformation of the core formed between initial loading (10 kg) and final loading (130 kg) is 3.1 to 3.8 mm. The amount of compression deformation can be controlled mainly by changing the amount of the above metal salts of unsaturated carboxylic acids, but it can also be controlled by the amount of the other chemical, vulcanization conditions, etc. Even if the amount of compression deformation is controlled by any one of the above methods, the resilience coefficient is decreased and flying performances are deteriorated when the amount of deformation of the core 12 exceeds 3.8 mm. The resulting ball is too soft and exhibits heavy and unsatisfactory feeling, and the durability is also low. On the contrary, when the amount of deformation is smaller than 3.1 mm, hard and an inferior feeling is obtained.

A two-piece golf ball can be obtained by covering a cover 10 on the core 12 for golf ball thus obtained. The thickness of the cover 10 is preferably 1.5 to 3.0 mm. As the cover 10, there can be normally used those which contain an ionomer resin as a base material and, if necessary, fillers (e.g. titanium dioxide, barium sulfate, etc.) to be added for the purpose of coloring. When the thickness of the cover 10 becomes smaller than 1.5 mm, an excessive amount of spin is put on the golf ball and flying performances become inferior. Further, it becomes too soft and unsatisfactory in view of feeling, thereby approaching to the feeling of the one-piece golf ball, and it is not preferred. On the other hand, when the thickness exceeds 2.5 mm, hard, heavy and inferior feeling is obtained.

A method of coating an ionomer resin on the cover 10 is known to the person skilled in the art, and it is normally conducted by an injection molding.

It is preferred that the contact area 14 obtained when the golf ball obtained according to the present invention is hit with a golf club at a head speed of 45 m/second is 4.3 to 5.0 $cm^2$. When the contact area 14 is smaller than 4.3 $cm^2$, the contact surface with respect to the club is too small, control properties become inferior. Further, the hit feeling is hard and an inferior feeling is obtained. On the other hand, when the contact area 14 exceeds 5.0 $cm^2$, a resiliency becomes inferior and an inferior feeling is obtained, and it is not preferred.

As described above, the hit feeling of the two-piece golf ball of the present invention is similar to that of the thread wound golf ball and flying performances of the two-piece golf ball per se are maintained. Thus, the two-piece golf ball of the present invention is superior in flying performances, hit feeling and control properties.

EXAMPLES

The following Examples and Comparative Examples further illustrate the present invention in detail but are not to be construed to limit the scope thereof.

Examples 1 to 3 and Comparative Examples 1 to 2

The formulation components of the core shown in Table 1 were kneaded to prepare a rubber composition, respectively. The rubber composition was subjected to a vulcanization molding in a mold under conditions shown in Table 1. The hardness distribution and the compression strength of the core 12 thus obtained are shown in Table 1.

The cover 10 obtained from the formulation components of the cover 10 according to a normal method was coated on the core 12. The stiffness and the thickness of the cover are shown in Table 1.

The hardness (PGA indication), the durability index, resilience coefficient, the flying performances (e.g. launch angle, spin, carry, etc.), the contact area 14 and the evaluation of feeling of the resulting two-piece golf ball are shown in Table 2.

TABLE 1

| | | | Example No. | | | Comparative Example No. | | |
|---|---|---|---|---|---|---|---|---|
| | | | 1 | 2 | 3 | 1 | 2 | 3 |
| Core | Formulation | BR-01[1] | 100 | 100 | 100 | 100 | 100 | 100 |
| | | Zinc acrylate | 23 | 25 | 29 | 35 | 18 | 25 |
| | | Zinc oxide | 24.0 | 22.5 | 21.0 | 52 | 25 | 22.5 |
| | | Antioxidant | 0.5 | 0.5 | 0.5 | 0.5 | 0.5 | 0.5 |
| | | Dicumyl peroxide | 2.0 | 1.5 | 1.0 | 1.2 | 2.5 | 1.8 |
| | Vulcanizing condition | | 140° C. × 25 minutes and 170° C. × 10 minutes | 140° C. × 25 minutes and 170° C. × 10 minutes | 140° C. × 25 minutes and 170° C. × 10 minutes | 145° C. × 25 minutes and 170° C. × 10 minutes | 135° C. × 25 minutes and 170° C. × 10 minutes | 165° C. × 25 minutes |
| | Hardness distribution | Center | 71 | 73 | 75 | 79 | 68 | 60 |
| | | Location which is | 72 | 74 | 76 | 80 | 69 | 71 |

TABLE 1-continued

| | | | Example No. | | | Comparative Example No. | | |
|---|---|---|---|---|---|---|---|---|
| | | | 1 | 2 | 3 | 1 | 2 | 3 |
| | | 5 mm away from the center | | | | | | |
| | | Location which is 10 mm away from the center | 72 | 74 | 76 | 81 | 69 | 71 |
| | | Location which is 15 mm away from the center | 72 | 74 | 76 | 81 | 69 | 76 |
| | | Surface | 73 | 75 | 77 | 82 | 70 | 78 |
| | Amount of compression deformation | (mm) | 3.70 | 3.40 | 3.15 | 2.85 | 4.10 | 3.93 |
| Cover | Formulation[2] | Hi-milan 1706 | 50 | 50 | 50 | 50 | 50 | 50 |
| | | Hi-milan 1605 | 50 | 50 | 50 | 50 | 50 | 50 |
| | Stiffness[3] | 23° C. × 2 weeks | 3300 | 3300 | 3300 | 3300 | 3300 | 3300 |
| | Thickness of cover | (mm) | 2.3 | 2.3 | 2.3 | 2.3 | 2.3 | 2.3 |

1. Commercially available butadiene rubber from Japan Synthetic Rubber Co., Ltd.

2. 2 Parts by weight of titanium oxide ($TiO_2$) was added to 100 parts by weight of an ionomer resin and the resulting mixture was subjected to coloring using an extruder to prepare a cover composition.

3. Stiffness: It was measured by a stiffness tester manufactured by Toyo Seiki Co., Ltd. The composition was subjecting to a press molding to form a flat plate, which was pressed and allowed to stand at 23° C. at a humidity of 50% for 2 weeks to give a sample to be measured.

As is apparent from the results of Tables 1 and 2, the golf balls of Examples 1 to 3 of the present invention are light and soft and superior in hit feeling, and they are extremely similar to a thread wound golf ball. Further, they are superior in durability and flying performances.

Regarding the golf ball of Comparative Example 1, the compression strength of the core is large and the amount of deformation is small (2.85 mm). Further, the hardness of the golf ball is high, and its feeling is too hard and heavy and inferior.

TABLE 2

| | | | Example No. | | | Comparative Example No. | | |
|---|---|---|---|---|---|---|---|---|
| | | | 1 | 2 | 3 | 1 | 2 | 3 |
| Evaluation of ball | Hardness (PGA indication) | | 87 | 93 | 99 | 107 | 82 | 88 |
| | Durability index[1] | | 88 | 100 | 110 | 130 | 70 | 85 |
| | Resilience coefficient (40 m/s) | | 0.758 | 0.766 | 0.776 | 0.790 | 0.743 | 0.750 |
| | Flying performances[2] | Launch angle (°) | 13.1 | 12.9 | 12.8 | 12.6 | 13.2 | 13.0 |
| | | Spin (rpm) | 2600 | 2700 | 2800 | 2950 | 2400 | 2500 |
| | | Carry (yds) | 230.5 | 232 | 231.5 | 229 | 228 | 229 |
| | Contact area ($mm^3$) (45 m/s) | | 4.90 | 4.72 | 4.53 | 4.25 | 5.10 | 4.60 |
| | Evaluation of feeling[3] | | Light and soft, good o | Light and soft, good o | Light and soft, good o | Hard and heavy x | Too soft and heavy, dull, no resiliency x | Too soft and heavy, inferior resiliency Δ–x |

1. Durability index: A golf ball was hit at a speed of 45 m/second using a golf ball hitting test machine (Swing Robot, manufactured by True Temper Co.), and the number of times until the golf ball was broken was measured. The resulting value was indicated as an index in case of the value of the golf ball of Example 2 being 100.

2. 45 m/second W1 flight (flying performances): Test was conducted by hitting a golf ball with a W1 (No. 1 wood club) at a speed of 45 m/second using the above golf ball hitting test machine.

3. Hit feeling was evaluated by ten professional golfers.

Regarding the golf ball of Comparative Example 2, the compression strength of the core is small and the amount of deformation is large (4.10 mm). Further, the hardness of the golf ball is low, and its feeling is soft and heavy and inferior in resiliency. The durability is also inferior.

The golf ball of Comparative Example 3 corresponds to the golf ball of Example 2 of Japanese Patent Laid-Open Publication No. 5-123422, but the resilience coefficient is low (energy loss is large), flying performances are inferior and the center part of the core is soft. Therefore, the feeling is inferior and the resiliency becomes inferior.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A two-piece golf ball comprising a core made of a rubber composition containing a base rubber, a co-crosslinking agent and an organic peroxide, and a cover covering said core, said core containing 20 to 30 parts by weight of the co-crosslinking agent based on 100 parts by weight of the base rubber, a hardness of said core, measured by a JIS-C type hardness tester, being within a range from 70 to 80 at any part from the center to the surface, a difference in hardness at any part being not more than 5 and an amount of compression deformation of said core formed between initial loading (10 kg) and final loading (130 kg) being 3.1 to 3.8 mm.

2. The two-piece golf ball according to claim 1, wherein a contact area obtained when the golf ball is hit with a club at a head speed of 45 m/second is 4.3 to 5.0 $cm^2$.

* * * * *